US006561099B1

(12) United States Patent
Jentzsch et al.

(10) Patent No.: US 6,561,099 B1
(45) Date of Patent: May 13, 2003

(54) INKING METHOD AND APPARATUS

(75) Inventors: Anrdt Jentzsch, Coswig (DE); Uwe Becker, Radebeul (DE)

(73) Assignee: Koenig & Bauer AG, Würzburg (DE)

( * ) Notice: Subject to any disclaimer, the term of this patent is extended or adjusted under 35 U.S.C. 154(b) by 0 days.

(21) Appl. No.: 09/497,976

(22) Filed: Feb. 4, 2000

(30) Foreign Application Priority Data

Jun. 16, 1998 (DE) ..... 198 26 810

(51) Int. Cl.[7] ..... B41F 31/02
(52) U.S. Cl. ..... 101/484; 101/365
(58) Field of Search ..... 101/365, 364, 101/425, 350.5, 350.6, 366, 483–484

(56) References Cited

U.S. PATENT DOCUMENTS

| | | | | | |
|---|---|---|---|---|---|
| 3,730,089 | A | * | 5/1973 | McCutcheon | 101/363 |
| 3,848,529 | A | * | 11/1974 | Gegenhelmer et al. | 101/363 |
| 3,898,929 | A | * | 8/1975 | Arild et al. | 101/147 |
| 3,927,114 | A | * | 12/1975 | Matuschke | 101/366 |
| 4,023,487 | A | * | 5/1977 | Mitter | 101/366 |
| 4,669,382 | A | * | 6/1987 | Jentzsch et al. | 101/365 |
| 4,703,691 | A | | 11/1987 | Takeuchi et al. | 101/365 |
| 4,784,060 | A | | 11/1988 | Weisgerber et al. | 101/365 |
| 4,795,286 | A | * | 1/1989 | Shimoishi et al. | 401/209 |
| 4,986,180 | A | * | 1/1991 | Mischler | 101/365 |
| 5,010,820 | A | * | 4/1991 | Lüffler | 101/484 |
| 5,029,527 | A | | 7/1991 | Jeschke et al. | 101/365 |
| 5,040,459 | A | * | 8/1991 | Rambausek et al. | 101/365 |
| 5,103,728 | A | * | 4/1992 | Barney | 101/364 |
| 5,163,368 | A | | 11/1992 | Pensavecchia et al. | 101/365 |
| 5,170,711 | A | | 12/1992 | Maier et al. | 101/365 |
| 5,213,044 | A | * | 5/1993 | Elia et al. | 101/425 |
| 5,341,164 | A | * | 8/1994 | Miyazawa et al. | 347/88 |
| 5,383,395 | A | * | 1/1995 | Buschulte | 101/365 |
| 5,419,247 | A | * | 5/1995 | Bachmann | 101/364 |
| 5,560,294 | A | * | 10/1996 | Anders et al. | 101/366 |
| 5,724,890 | A | * | 3/1998 | Deschner et al. | 101/366 |
| 5,727,463 | A | * | 3/1998 | Deschner et al. | 61/365 |
| 5,735,208 | A | | 4/1998 | Hummel et al. | 101/348 |
| 5,806,429 | A | | 9/1998 | Laubmann | 101/365 |
| 5,862,756 | A | * | 1/1999 | Gorter | 101/364 |
| 5,950,536 | A | * | 9/1999 | Erbstein | 101/177 |
| 5,960,719 | A | * | 10/1999 | Voge et al. | 101/365 |
| 5,964,757 | A | * | 10/1999 | Hummel et al. | 101/483 |
| 5,967,049 | A | * | 10/1999 | Seymour et al. | 101/484 |
| 5,967,050 | A | * | 10/1999 | Seymour | 101/365 |
| 6,012,389 | A | * | 1/2000 | Roskovock et al. | 101/365 |
| 6,024,015 | A | * | 2/2000 | Dillig et al. | 101/350.5 |
| 6,024,018 | A | | 2/2000 | Darel et al. | 101/365 |
| 6,085,652 | A | | 7/2000 | Deschner et al. | 101/366 |
| 6,142,078 | A | * | 11/2000 | Lachajewski | 101/365 |
| 6,318,266 | B1 | | 11/2001 | Weill | 101/366 |
| 2001/0011512 | A1 | * | 8/2001 | Koehler | 101/365 |

FOREIGN PATENT DOCUMENTS

| | | | |
|---|---|---|---|
| DE | 2324462 | 5/1974 | |
| DE | 2913825 | 10/1979 | |
| DE | 320681 | 10/1982 | |
| DE | 3818339 | 1/1989 | |
| DE | 94 06 347.8 | 7/1994 | |
| DE | 4339939 | 6/1995 | |
| EP | 339711 | 11/1989 | |
| EP | 364736 | 4/1990 | |
| EP | 739729 | 10/1996 | |
| WO | WO 79/00955 | * 11/1979 | 101/364 |
| WO | WO 95/03668 | 2/1995 | |

* cited by examiner

*Primary Examiner*—Eugene H. Eickholt
(74) *Attorney, Agent, or Firm*—Goodwin Procter LLP

(57) ABSTRACT

A method for inking of pasty printing inks in an inking apparatus having an ink tray, an ink tray roller, a variable ink gap at the bottom of the ink tray, and an ink dosing element disposed along the ink tray roller, which comprises separating the amount of printing ink into a minimal amount of printing ink and a consumed amount of printing ink, disposing the minimal amount within the ink tray, and applying the consumed amount of printing ink to the ink tray roller through the ink dosing element.

11 Claims, 2 Drawing Sheets

INKING METHOD AND APPARATUS

This is a continuation of international application No. PCT/DE99/01763, filed on Jun. 12, 1999.

FIELD OF INVENTION

The invention relates to an inking method and apparatus for pasty printing inks in printing presses.

BACKGROUND

Inking systems in printing presses with an ink tray, an ink tray roller and plurality of ink dosing elements longitudinally along the ink tray roller at the bottom of the ink tray and establishing a variable ink gap are known e.g. from German patent No. 3,030,774. The more viscous (pasty) printing ink is filled into the open wedge-shaped ink storage space formed between the bottom of the ink tray including the ink dosing elements and the ink tray roller.

The very large ink storage space and with it the difficulties during ink change and cleaning are problematic. Furthermore ink zone related ink dosing is only possible by ink dosing elements.

Inking systems with a reduced wedge-shaped ink storage space and in closed design are also known e.g. from German patent No. 4,339,939. The inking of the reduced and closed ink storage space is made with pressurized ink cartridges. The difficulties with ink dosing and cleaning are also not eliminated in this case.

BRIEF DESCRIPTION OF INVENTION

It is the object of the present invention is to provide a method and an apparatus for inking with improved ink dosing and reduced need for cleaning.

The foregoing object is solved according the invention by separating the amount of printing ink into a minimal amount of printing ink and a consumed amount of printing ink. The minimal amount of printing ink is contained in the ink tray and the consumed amount of printing ink is applied directly to the ink tray roller.

BRIEF DESCRIPTION OF THE DRAWING

The invention is described below in greater detail with regard to embodiments of the invention, by reference being had to the drawing, wherein.

DETAILED DESCRIPTION

Figure 1:
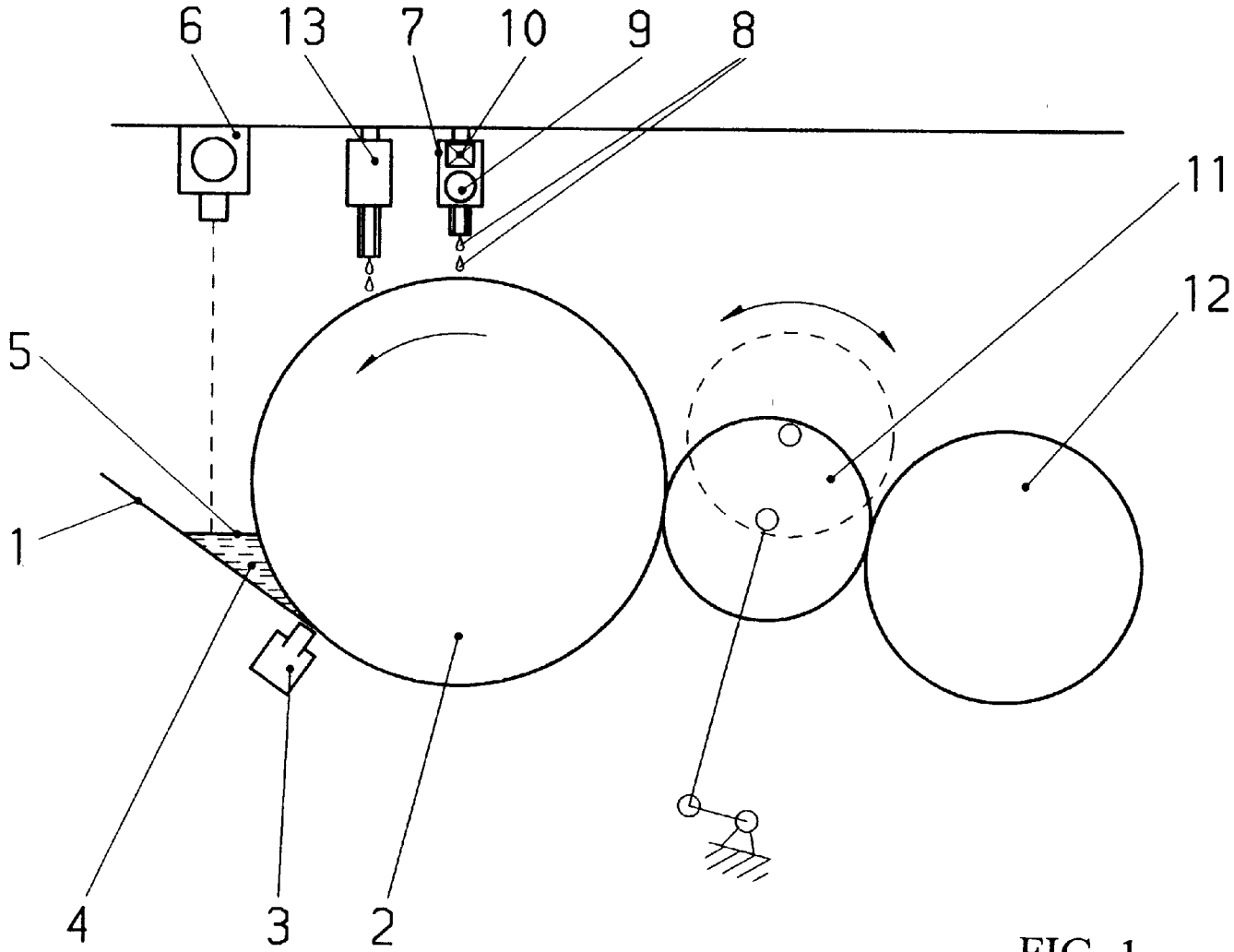
FIG. 1 shows the apparatus for inking in an open ink tray design.

In the known open ink tray designs an ink tray roller 2 is allocated to the ink tray 1. A plurality of ink dosing elements 3 longitudinally along the ink tray roller and establishing a variable ink gap are at the bottom of the ink tray 1 (FIG. 1).

Usually one ink dosing element 3 is assigned to every ink zone. The ink tray 1 is an open ink tray and contains only the minimal amount of printing ink 4. The minimal amount of printing ink 4 is defined by the amount of printing ink absolutely necessary to establish the inking function by wetting the ink tray roller and by maintaining a defined hydrodynamic pressure in the ink tray. The surface 5 of the minimal amount of printing ink 4 is sensed with a level control device 6 detecting the ink level, i.e. the level of the minimal amount of printing ink 4. The level control device 6 generates appropriate control signals to increase or to decrease the minimal amount of printing ink in the ink tray 1, or by warning signals if the defined level of minimal amount of printing ink is too low or too high within the ink tray.

At least in one inking system 7 for the consumed amount of printing ink 8 is allocated to the ink tray roller 2.

The consumed amount of printing ink 8 is defined by the amount of printing ink necessary for inking the printing form for the pertaining printing job, i. e. the fed consumed amount of printing ink 8 corresponds to the amount of printing ink for inking the printing form and is eventually consumed by depositing the ink onto the printing material.

Appropriately an inking system 7 is assigned to each ink zone or ink zone group, depending upon the amount of printing ink consumed, and disposed in longitudinal succession along the ink tray roller 2.

A single inking system 7 is of a design (not shown) longitudinally traversing the ink tray roller 2, whereby the level control device 6 is appropriately allocated to the single traversing inking system 7. It is advantageous to connect the inking system 7 and/or the level control device 6 to a known traversing ink agitator.

Each inking system 7 is connected to an ink supply unit (not shown) and contains a dosing device 9 and a pressure switch 10. The dosing device 9 is controlled by a device (not shown) for inputting setting data for the inking system equivalent to the ink consumption.

The setting data for the inking system are usually derived from a known printing plate scanner data or from pre-press data (CIP3), inking unit setting data, or from experience. The control of the consumed amount of printing ink 8 is also possible by a level control of the minimal amount of printing ink, i. e. increased minimal amount of printing ink causes too much supply of consumed amount of ink, and this requires a decrease of the consumed ink to a lesser supplied of amount of consumed ink which makes an increase of the amount of consumed amount necessary.

At the end of the printing job the supply of consumed amount of printing ink is stopped, the minimal amount of printing ink is used up, and a cleaning fluid is applied to the printing ball.

It is also possible to supply the printing ink by an ink supply system with ink cartridges in a closed ink tray design of reduced ink storage space.

The ink tray roller 2 followed by an ink duct 11, and the ink duct 11 is followed by an ink oscillator roller 12 in a known inking unit (not shown). The ink duct 11 is between the ink tray roller 2 and the oscillating roller 12 moving during the printing process and is brought into permanent contact with the ink tray roller 2 as well as the oscillating roller 12 for improved reactivity, i.e. quick inking at a new printing job, and for enhanced cleaning. A cleaning fluid is applied to the ink tray roller 2 by a cleaning device 13 during the cleaning process.

Figure 2:
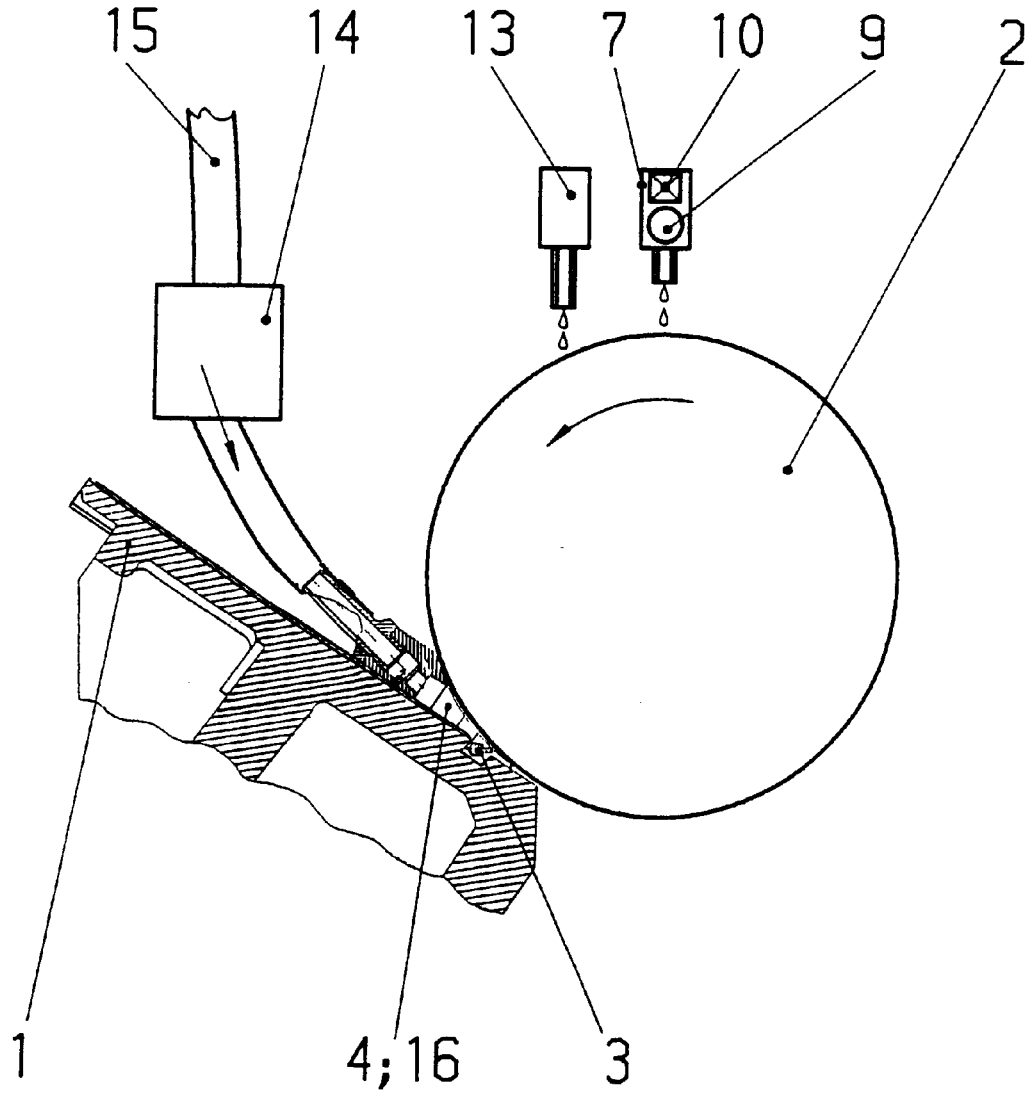
FIG. 2 shows the apparatus for inking in a closed ink tray design.

FIG. 2 shows an inking system in closed ink tray design, wherein the minimal amount of printing ink 4 is in a reduced and closed ink storage space 16. The minimal amount of printing ink 4 is controlled by a pressure control 14 in the ink supply line 15.

The separation between the minimal amount of printing ink and the consumed amount of printing ink and the supply of the amount consumed ink in ink zones enables a more exact ink dosing and minimizes the cleaning efforts during changes of printing jobs.

We claim:

1. A method for inking of pasty printing inks in an inking apparatus having an ink tray, an ink tray roller, a variable ink gap at the bottom of the ink tray, and an ink dosing element disposed along the ink tray roller, which comprises determining the consumed amount of printing ink, separating the amount of printing ink into a minimal amount of printing ink and a consumed amount of printinig ink, disposing said minimal amount within said ink tray, disposing said consumed amount of printing ink in ink zones or ink zone groups, applying said consumed amount of printing ink to said ink tray roller through said ink dosing element, at the end of a printing job stopping feeding of the consumed amount of printing ink, and exhausting the minimal amount of printing ink.

2. The method of claim 1, wherein said consumed amount of printing ink is disposed in a plurality of ink zones or ink zone groups, and is applied to said ink tray roller through a plurality of ink dosing elements.

3. The method of claim 1, wherein the consumed amount of printing ink is determined from inking unit setting data.

4. The method of claim 1, wherein the consumed amount of printing ink is determined from printing plate scanner data.

5. The method of claim 1, wherein the consumed amount of printing ink is determined from pre-press data.

6. The method of claim 1, wherein the consumed amount of printing ink is controlled by a level-control.

7. The method of claim 1, further comprising supplying the consumed amount of printing ink by a dosing element and a pressure switch.

8. The method of claim 1 further comprising supplying the consumed amount of printing ink by an ink cartridge through an ink dosing element.

9. The method of claim 1, further comprising providing said minimal amount of printing ink in an open ink tray.

10. The method of claim 1, further comprising providing said minimal amount of printing ink in a closed ink tray with a reduced ink storage space.

11. The method of claim 1, further comprising at the end of a printing job applying a cleaning fluid to the ink tray roller.

* * * * *